United States Patent [19]

Gartland

[11] 4,170,258

[45] Oct. 9, 1979

[54] MOLD MAKING MACHINE

[76] Inventor: William R. Gartland, 236 Elmwood Dr., Hubbard, Ohio 44425

[21] Appl. No.: 836,082

[22] Filed: Sep. 23, 1977

[51] Int. Cl.[2] ..... B22C 9/02; B22C 15/08

[52] U.S. Cl. ..... 164/187; 164/244; 164/350; 425/457

[58] Field of Search ..... 164/172, 173, 238, 239, 164/242, 243, 244, 350, 187; 425/457

[56] References Cited

U.S. PATENT DOCUMENTS

| | | | |
|---|---|---|---|
| 1,010,643 | 12/1911 | Kramer | 164/238 |
| 1,846,306 | 2/1932 | Bunting et al. | 164/172 |
| 2,997,757 | 8/1961 | Buhrer et al. | 164/350 X |
| 3,234,602 | 2/1966 | Hunter et al. | 164/244 X |

FOREIGN PATENT DOCUMENTS

| | | | |
|---|---|---|---|
| 682572 | 10/1939 | Fed. Rep. of Germany | 425/457 |

*Primary Examiner*—Robert D. Baldwin
*Attorney, Agent, or Firm*—Webster B. Harpman

[57] ABSTRACT

A machine for making molds in which cast welding rods can be formed includes a vertically movable pressure plate having a plurality of pointed depending rods thereon and apparatus including a hydraulically actuated piston and cylinder assembly for moving the pointed rods into and out of a sand filled flask to form cavities in which welding rods are subsequently cast. The machine includes a second pressure plate which is apertured and through which the rods move with the second pressure plate forming pouring buttons and runner configurations in the sand in the flask to facilitate pouring of the metal in the cavities formed by the rods.

7 Claims, 3 Drawing Figures

MOLD MAKING MACHINE

BACKGROUND OF THE INVENTION (1) Field of the Invention

This invention relates to mold making machines in which a mold or a pattern for metal castings may be formed.

(2) Description of the Prior Art:

U.S. Pat. No. 1,010,643 discloses a machine for forming patterns for metal castings and in which elongated cavities are formed in sand in a flask in which elongated cylindrical members such as sash weights could be cast. In the disclosure a plurality of patterns are positioned in a flask, the flask filled with sand about the patterns, and the device then turned upside down to permit the flask and the sand therein to be moved away from the patterns to form the casting cavities.

In the present invention a sand filled flask is positioned below a pair of pressure plates, one of which is apertured and the other, thereabove, is provided with a plurality of pointed rods or patterns arranged for registry with the apertures in the other plate so that upon movement of the rods downwardly into the sand in the flask a plurality of cavities will be formed. Simultaneously the lower, apertured plate, is moved against the sand to compact the same and impress pouring buttons and runners therein which communicate with the cavities. The flask with the cavities, runners and pouring buttons formed therein is removed from the machine upon the elevation of the rods and pressure plates whereupon another sand filled flask may be positioned in the machine and the process repeated.

SUMMARY OF THE INVENTION

A mold making machine positions a pair of pressure plates in superimposed relation in a vertical framework and above an area in which a sand filled flask is removably positioned. Means is provided for moving the pressure plates vertically and the upper one of the pressure plates is provided with a plurality of depending pointed rods which register with and pass through a plurality of apertures in the lower pressure plate. The actuating means first moves the upper pressure plate and the rods downwardly to form a plurality of elongated vertically positioned cavities in the sand filled flask and when the upper pressure plate reaches the lower pressure plate the same is moved thereby against the sand in the flask to impress pouring buttons and metal runners therein. Retraction of the pressure plates and the rods permits the flask with its desirable pattern formed therein to be removed for subsequent casting of welding rods therein.

DESCRIPTION OF THE PREFERRED EMBODIMENT

Figure 1:
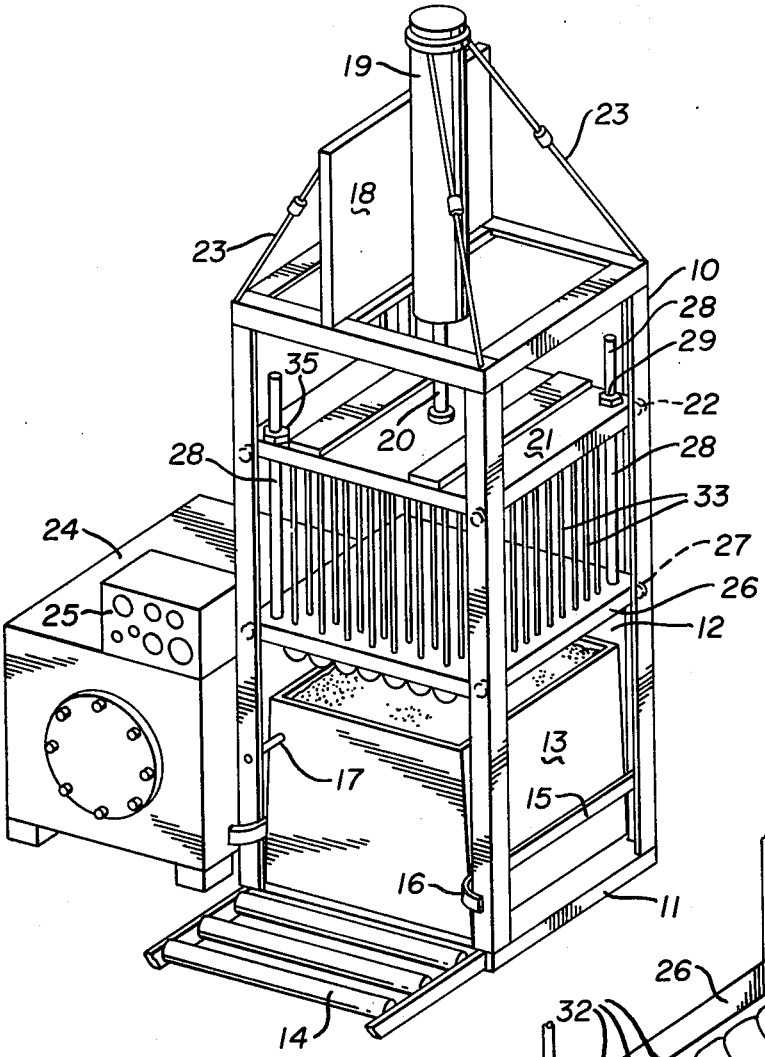
FIG. 1 is a perspective view of the mold making machine with parts thereof in elevated relation to a sand filled flask therein.
Figure 2:
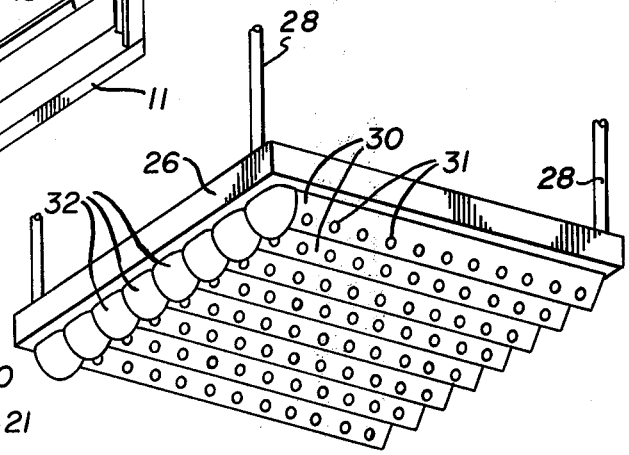
FIG. 2 is an enlarged bottom perspective view of a part of the machine of FIG. 1.

In the form of the invention chosen for illustration and description herein and as best illustrated in FIG. 1 of the drawings, the mold making machine comprises a vertically standing framework 10 having a base 11 and defining an open area 12 in which a sand filled flask 13 may be readily positioned. For convenience a roller conveyor 14 is provided so that the sand filled flask 13 can be easily rolled into the open area 12 and removed therefrom. Guides 15 having curved outer ends 16 facilitate the placement of the sand filled flask 13 in the open area 12 of the mold making machine. One or more latches 17 are preferably provided to insure the positioning of the sand filled flask 13 in the machine in the position illustrated in FIG. 1 of the drawings. The upper part of the frame 10 supports a bracket 18 to which the cylinder 19 of a hydraulic piston and cylinder assembly is secured, the piston having a depending rod 20 extending out of the bottom of the cylinder 19 and attached to a first pressure plate 21. Rollers 22 on the corners of the first pressure plate 21 engage the vertical members of the frame 10 which act as guides when the first pressure plate 21 is moved up and down relative thereto by the hydraulic piston and cylinder assembly 19 and 20. Guy rods 23 secure the bracket 18 and the cylinder 19 to the frame 10 and a fluid reservoir and pump together with a suitable actuating electric motor are positioned in a housing 24 and are in communication with the hydraulic cylinder 19 and arranged to move the piston therein, the piston rod 20 and the first pressure plate 21 alternately up and down. Gauges and controls 25 are mounted on the housing 24 so as to be convenient to an operator. A second pressure plate 26 is positioned in the frame 10 for vertical movement relative thereto and is provided with secondary rollers 27 on the corners thereof engaging the frame members of the frame 10 and vertical guide members 28 are positioned on each of the corners of the second pressure plate 26 and extend upwardly therefrom through openings 29 in the first pressure plate 21. The bottom of the second pressure plate 26 as may best be seen by referring to FIG. 2 of the drawings is provided with a plurality of transversely extending V-shaped configurations 30, each of which has a plurality of apertures 31 in each of its sides and each of which V-shaped configurations 30 has a pouring button configuration 32 on one of its ends.

By referring again to FIG. 1 of the drawins, it will be seen that a plurality of rods 33 are attached to the bottom of the first pressure plate 21 in evenly spaced relation to one another and extend downwardly through the second pressure plate 26 and the apertures 31 in the V-shaped configurations 30 thereof.

Figure 3:
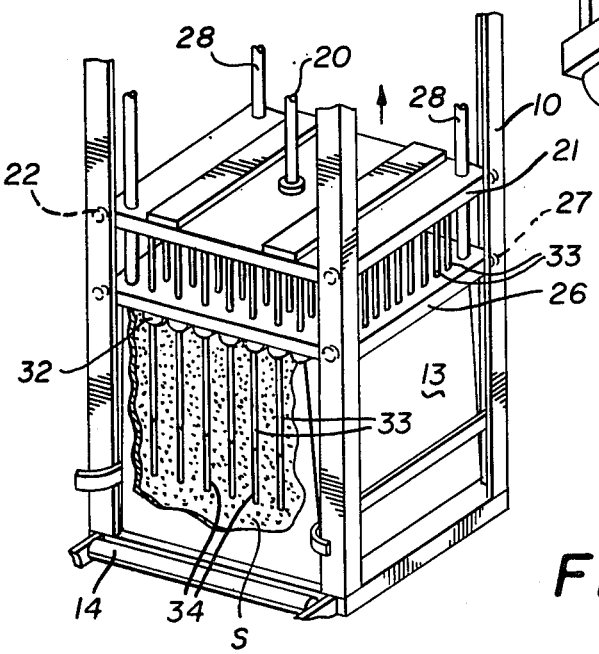
FIG. 3 is a perspective view of the machine of FIG. 1 with parts broken away and parts in cross section showing parts thereof in engagement in the sand filled flask.

By referring now to FIG. 3 of the drawings, a portion of the mold making machine illustrated in FIG. 1 may be seen and it will be observed that the piston rod 20 has moved downwardly so as to move the first pressure plate 21 downwardly in the frame 10 along with the pointed rods 33. The secondary pressure plate 26 first moves downwardly by gravity. When the first pressure plate 21 engages the second pressure plate 26, it will move it further downwardly into with the sand S in the flask 13 and impress the V-shaped configurations 30 thereinto along the pouring button configurations 32 to form the runners and pouring buttons in the mold. Upon completion of the downward travel and the desirable penetration of the pointed rods 33, the hydraulic piston and cylinder assembly reverses and moves the pointed rods 33 upwardly out of the sand S leaving the desirable cavities 34 therein in which welding rods may be subsequently cast.

Adjustable members 35 are positioned on the upper ends of the vertical guide members 28 so that when the first pressure plate 21 moves upwardly into engagement with the same vertical guide members 28 will then move the second pressure plate 26 upwardly to the position shown in FIG. 1 of the drawings. When this occurs the sand filled flask 13 with the cavities 34 therein connected by the runners and the pouring buttons formed by the configurations 31 and 32 respectively can then be released from its position in the machine and rolled outwardly therefrom on the conveyor 14 and another sand filled flask can be positioned in the machine for a subsequent operation.

It will occur to those skilled in the art that vibrators which may be air or electric and as known in the art, can be attached to the first pressure plate 21 so that during the formation of the cavities 34 in the sand filled flask 13, the vibrators can be operated to assure compact sand clearly and smoothly defining the cavities 34 and the configurations comprising the runners and pouring buttons as hereinbefore described.

A mold casting machine formed in accordance with this invention has 226 of the pointed rods 33, they are each 0.438 inches in diameter with one end threaded for engagement in a threaded opening in the first pressure plate 21 and its opposite or free end pointed. A 48 inch stroke hydraulic piston and cylinder assembly with a 5 inch piston in a hydraulic system having a 10 horse power electric motor and capable of generating 300 PSI has been found suitable for operation. In a typical operation 15 of the flasks 13 can be processed as hereinbefore described and can be cycled every 90 minutes for a 8 hour turn or shift capacity of 18,000 lbs. of highly satisfactory welding rods. This compares with the heretofore average production of 1,500 lbs. of such rods by the heretofore used "squeezer" molding process in a comparable 8 hour turn.

The welding rods, which are generally termed "Ferro-Weld" in the industry, are removed from the mold after casting by shaking the sand out of the flask, breaking off the runners and subjecting the rods to shot blasting for desirable cleaning, all of which will be readily recognized by those skilled in the casting art.

Although but one embodiment of the present invention has been illustrated and described, it will be apparent to those skilled in the art that various changes and modifications may be made therein without departing from the spirit of the invention.

Having thus described my invention what I claim is:

1. In a mold making machine for producing molds for cast welding rods and having a vertical frame with an open area in the bottom thereof for the reception of a sand filled flask and motion imparting means on the upper end thereof; the improvement comprising first and second pressure plates positioned in said vertical frame for vertical movement, a member fixedly connecting the motion imparting means to said first pressure plate and a plurality of spaced pointed small diameter rods attached to the first pressure plate in depending relation thereto and arranged for registry with a plurality of spaced openings in said second pressure plate which is positioned therebelow, interconnecting means between the first and second pressure plates arranged to permit limited relative movement thereof whereby the first pressure plate upon being moved downward by said motion imparting means engages the second pressure plate therebelow and moves the same downwardly into the sand filled flask when the pointed rods have engaged the sand therein so as to form elongated small diameter spaced vertical cavities therein and whereby upward movement of the first pressure plate moves the second pressure plate upwardly away from the sand filled flask when the pointed rods have moved upwardly out of the cavities formed therein by upward movement of said first pressure plate by said motion imparting means.

2. The mold making machine of claim 1 and wherein said motion imparting means in said machine comprises a hydraulic piston and cylinder assembly and a source of hydraulic pressure for actuating the same.

3. The mold making machine of claim 1 and wherein said interconnecting means between the first and second pressure plates comprises vertical guide members on the upper surface of said second pressure plate extending through openings in the first pressure plate thereabove together with devices on said vertical guide members engagable with the upper surface of said first pressure plate when the same moves upwardly thereagainst.

4. The mold making machine of claim 1 and wherein depending longitudinally extending V-shaped configurations are formed integrally on the bottom of said second pressure plate and said plurality of openings extend therethrough, said V-shaped configurations arranged to form runners for hot metal in communication with the cavities in a sand filled flask.

5. The mold making machine of claim 1 and wherein depending longitudinally extending V-shaped configurations are formed integrally on the bottom of said second pressure plate and said plurality of openings extend therethrough, said V-shaped configurations arranged to form runners for hot metal in communication with the cavities in a sand filled flask and wherein pouring button configurations are formed on one of the ends of each of said V-shaped configurations on said second pressure plate so as to form pouring buttons in communication with said runners formed in the sand in said flask.

6. The mold making machine of claim 1 and wherein said vertical frame in said machine includes vertical guide members and rollers are positioned on said first and second pressure plates for registry in said vertical guide members.

7. The mold making machine of claim 1 and wherein latch means are positioned on said vertical frame in the open area thereof and arranged to secure said sand filled flask in said open area.

* * * * *